United States Patent [19]

Smith

[11] 4,275,884

[45] Jun. 30, 1981

[54] METHOD AND APPARATUS FOR PERIODIC PARTIAL DEACTIVATION OF AN AUTOMATIC PINSETTER

[75] Inventor: Ronald L. Smith, Boulder, Colo.

[73] Assignee: Century International Corp., Denver, Colo.

[21] Appl. No.: 869,800

[22] Filed: Jan. 16, 1978

[51] Int. Cl.[3] ..... A63D 5/00

[52] U.S. Cl. ..... 273/43 A; 273/54 R

[58] Field of Search ..... 273/43 R, 43 A, 54 R

[56] References Cited

U.S. PATENT DOCUMENTS

| | | | |
|---|---|---|---|
| 2,311,801 | 2/1943 | Winans | 337/112 X |
| 3,166,318 | 1/1965 | Barger | 273/43 R |
| 3,189,348 | 6/1965 | Keahey | 273/54 R UX |
| 3,889,947 | 6/1975 | Short | 273/43 A |
| 4,151,993 | 5/1979 | Payne et al. | 273/43 A |

*Primary Examiner*—Anton O. Oechsle

*Attorney, Agent, or Firm*—Edwin L. Spangler, Jr.

[57] ABSTRACT

This invention relates to an improved control circuit for use with a magnetic clutch and a Brunswick automatic pinsetter for the purpose of shutting down the pin retrieval function performed by the latter during those intervals when it is not needed, such circuit being characterized by a pair of parallel direct current paths to the clutch magnet, one of which is effective to instantaneously actuate the pin retrieval operation whenever a ball has been rolled while, at the same time, energizing the thermal element in a branch path to the other circuit which element, once it becomes hot, is effective to establish the alternate path to the clutch and maintain the pin retrieval function operative for a brief time interval after both the pinsetter's rake-cycle and pin-storage cycles have been completed. The improved circuit also functions to actuate the pin retrieval function even though the thermal element malfunctions and thus fails to establish the alternate current path, the only loss in function being the brief period of continued pin retrieval after the pin-raking and pin-storage cycles have been completed. The invention also encompasses the novel method of controlling the pin retrieval functions of the pinsetter which includes the steps of actuating the latter immediately upon the occurrence of an event that presumably results in the presence of downed pins that must be retrieved and stored, simultaneously energizing a thermal element and using the latter to establish an alternate way of keeping the pin retrieval function operative for a brief time interval following completion of the pinsetter's pin-raking and pin-storage cycles.

10 Claims, 5 Drawing Figures

Figure 3:
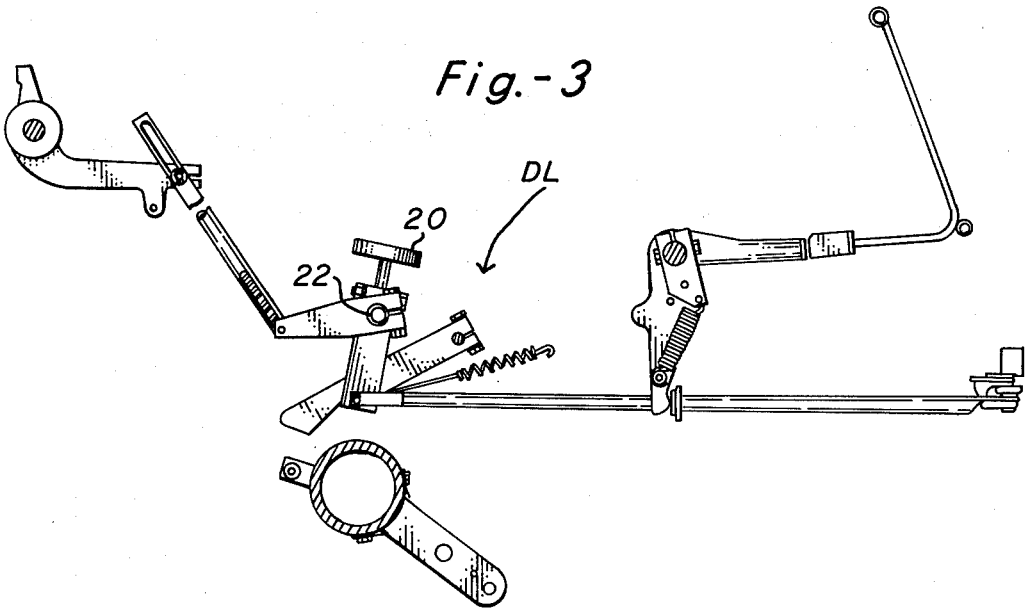

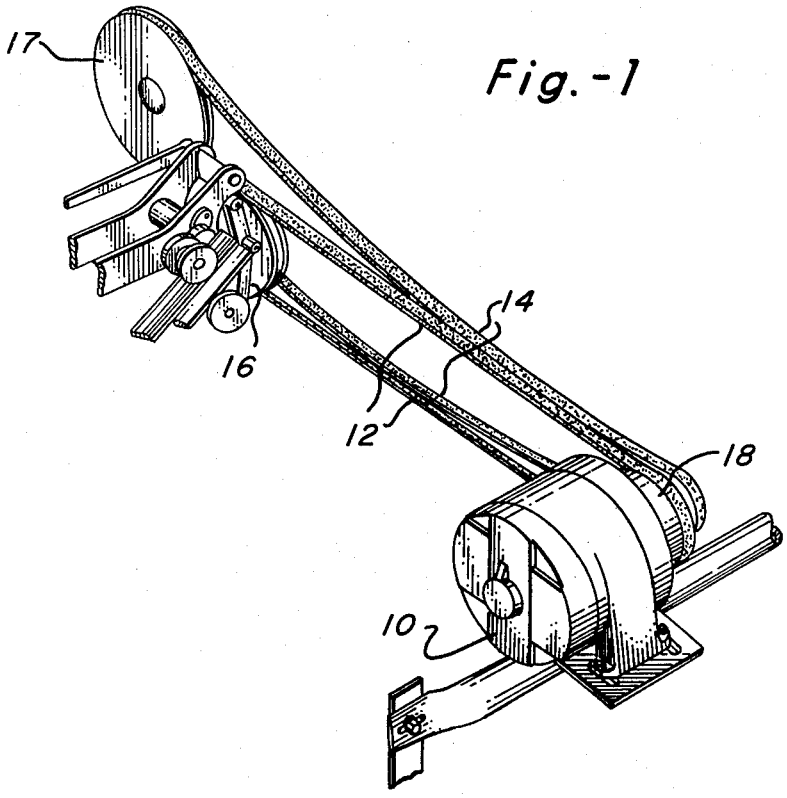
Fig.-1
Fig.-2
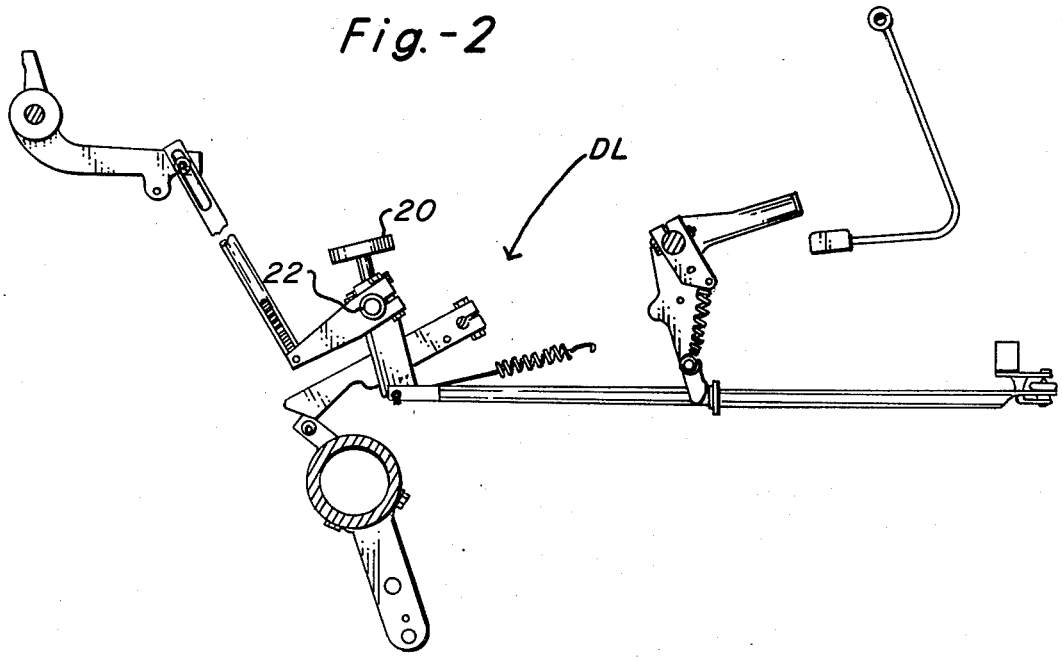

METHOD AND APPARATUS FOR PERIODIC PARTIAL DEACTIVATION OF AN AUTOMATIC PINSETTER

This invention relates to an improved control circuit for use with a magnetic clutch and a Brunswick automatic pinsetter for the purpose of shutting down the pin retrieval function performed by the latter during those intervals when it is not needed, such circuit being characterized by a pair of parallel direct current paths to the clutch magnet, one of which is effective to instantaneously actuate the pin retrieval operation whenever a ball has been rolled while, at the same time, energizing the thermal element in a branch path to the other circuit which element, once it becomes hot, is effective to establish the alternate path to the clutch and maintain the pin retrieval function operative for a brief time interval after both the pinsetter's rake-cycle and pin-storage cycles have been completed. The improved circuit also functions to actuate the pin retrieval function even though the thermal element malfunctions and thus fails to establish the alternate current path, the only loss in function being the brief period of continued pin retrieval after the pin-raking and pin-storage cycles have been completed. The invention also encompasses the novel method of controlling the pin retrieval functions of the pinsetter which includes the steps of actuating the latter immediately upon the occurrence of an event that presumably results in the presence of downed pins that must be retrieved and stored, simultaneously energizing a thermal element and using the latter to establish an alternate way of keeping the pin retrieval function operative for a brief time interval following completion of the pinsetter's pin-raking and pin-storage cycles.

Not long after the so-called "automatic pinsetters" of Brunswick and AMF came into widespread use, it was recognized that a good deal of unnecessary wear was taking place during those intervals when the pin retrieval functions of the pinsetter had been completed yet they remained operative while waiting for the bowler to initiate some further action that presumably would result in downed pins and a further need for the pin retrieval function. The most promising solution came in the form of a normally disengaged magnetic clutch placed on the output shaft of the motor used to drive the pin retrieval subassembly of the pinsetter which became operative to establish a driving connection therebetween only when there were downed pins to retrieve and store. More specifically, an apparatus was briefly marketed under the trademark "Idlematic" which had as its intended function the partial deactivation of the pin retrieval function of a Brunswick automatic pinsetter of the general type forming the subject matter of their U.S. Pat. No. 2,729,449 during those periods between balls when all the downed pins had been collected and a full ten pin set had been stored in position to be placed down on the alley at the conclusion of a frame. Of the relatively few units ever placed in service, none to applicant's knowledge proved practical nor, so far as is known, are any of them still in use. In fact, applicant's assignee has been advised that those Idlematic units that were in the field had to be removed due to their failing to perform as intended and, apparently, the defects therein either could not, or at least were not, cured.

Certain of the difficulties were mechanical ones that had to do with the clutch itself which, due to design deficiencies, either failed to actuate because of excessive wear or, alternatively, would not release. Whatever the cause of the mechanical failure, it was enough to render the unit completely unsatisfactory for its intended purpose. By the same token, from an electrical standpoint, the interlock circuit between the pinsetter and clutch left much to be desired. Any malfunction of the control circuit governing operation of the Idlematic resulted in the pinsetter itself becoming partially inoperative because the clutch formed the operative link between the motor and its pin retrieval subassembly. While means were provided for bypassing the switches in the clutch control circuit, if the clutch itself malfunctioned as previously noted or the rectifier supplying D.C. voltage thereto, then the pinsetter shut down to an extent where, for all practical purposes, it became inoperative.

Another problem was that of premature shut down. As is the case with the instant unit, deactivation of the pin retrieval function of the pinsetter was keyed to completion of both the pin-storage operation and the last half of the pin-placement function; however, completion of these functions could, on occasion, take place before all the downed pins had been retrieved. More specifically, the conditions necessary for shutting down the pin retrieval function of the pinsetter could, on occasion, be satisfied before all the "downed" pins had cleared the shaker deck which feeds the pin elevating conveyor. While the pinsetter would continue to function under these conditions, much more satisfactory operation resulted if the unit were allowed to complete the entire pin retrieval function before the latter was deactivated.

It has now been found in accordance with the teaching of the instant invention that these and other shortcomings of the prior art Brunswick pinsetter deactivator can, in fact, be overcome by the simple, yet unobvious, expedient of redesigning the clutch control circuit to include a pair of parallel D.C. circuits supplying power to the magnetic clutch, one of which powers a branch circuit that includes a thermal element which, upon energization, becomes operative to complete the alternate current path to the clutch. The latter current path constitutes a holding circuit operative to maintain the clutch in engaged position for a brief pre-set time interval that allows the pinsetter to complete its pin retrieval function even after the raking and pin-storage functions have terminated that trigger the deactivator to disengage the clutch. The thermal element does not respond quickly enough to use a circuit containing it as a primary source of power to the clutch because, to do so, would delay the onset of the all important pin retrieval function. Therefore, the same primary current path that energizes the thermal element is used to energize the clutch thus initiating the pin retrieval function instantaneously. Furthermore, if perchance the thermal element malfunctions and fails to establish the alternate current path to the clutch, the primary current path remains fully operative to both initiate and deactivate the pin retrieval function, the only thing lost being the holding function.

It is, therefore, the principal object of the present invention to provide a novel and improved deactivator for the pin retrieval function in a Brunswick automatic pinsetter.

Another object is the provision of an improved circuit for controlling the operation of the magnetic clutch in such a deactivator.

Still another objective of the invention forming the subject matter hereof is to provide means for reducing wear and tear on the pinsetter without, at the same time, adversely affecting any of the normal functions of the latter.

an additional object of the invention herein disclosed and claimed is to provide a deactivator for certain functions of a Brunswick pinsetter which includes a holding feature that overrides the triggering responses relied upon to initiate deactivation for a time period during which the pinsetter can complete the pin retrieval functions it is designed to perform under a given set of conditions.

Further objects are to provide a pinsetter deactivator which is simple to install, reliable, rugged, relatively maintenance free, easy to service, compact, efficient and quite inexpensive when considered in the light of the wear and tear on the pinsetter that it eliminates.

Figure 4:
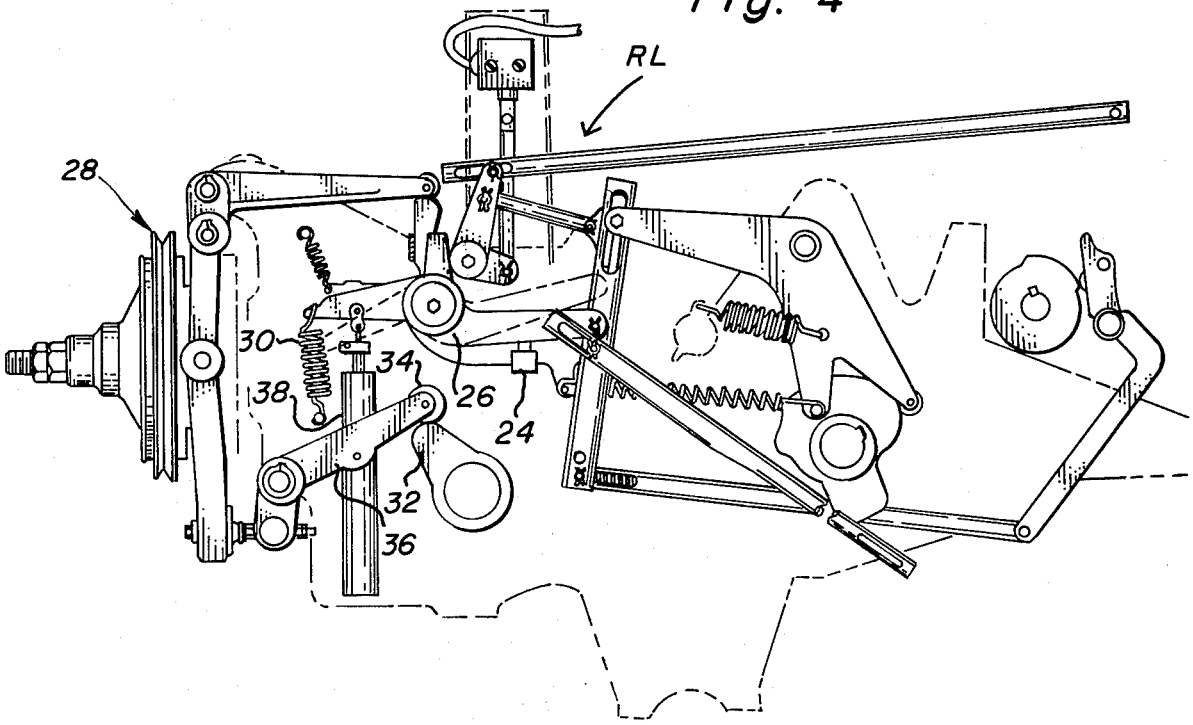
Figure 5:
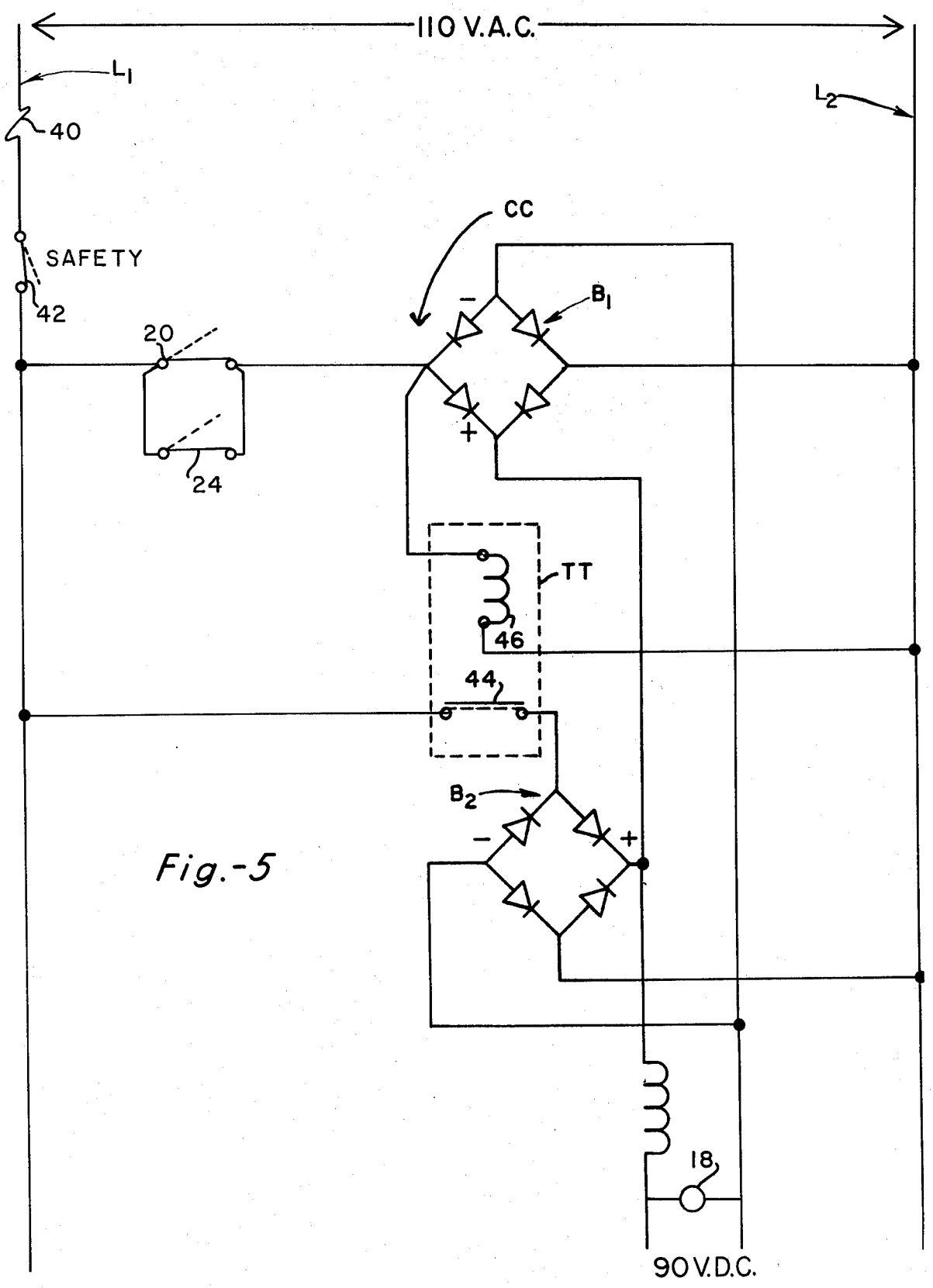

Other objects will be in part apparent and in part pointed out specifically hereinafter in connection with the description of the drawings that follows, and in which:

FIG. 1 is a fragmentary perspective view illustrating the placement of the normally disengaged clutch of the instant pinsetter deactivation system interposed between the power transfer mechanisms driving the pin retrieval functions of the pinsetter and the electric motor powering same;

FIGS. 2 and 3 are schematics showing how the normally closed switch of the deactivator circuit is released to closed position upon completion of the pin-placement function during which a set of ten pins is placed down on the alley thus initiating the pin retrieval operation necessary to refill the pin-storage subassembly, FIG. 2 showing the normally closed switch being held open upon completion of the pin-storage cycle which FIG. 3 shows the switch released to the closed position it occupies while the pin-storage subassembly is taking on a new set of pins supplied thereto by the pin retrieval subassembly;

FIG. 4 is a schematic showing how the pinsetter linkage controlling the pin-raking function is employed upon completion of the pin-raking cycle to hold open a second normally closed switch in the clutch control circuit, the particular switch actuating element of the linkage having also been shown in phantom lines in the position it occupies during the raking cycle where it has released said clutch control switch to its closed position; and, FIG. 5 is a circuit diagram showing the improved clutch control circuit of the instant invention.

Referring next to the drawings for a detailed description of the present invention and, initially, to FIG. 1 for this purpose, reference numeral 10 designates an electric motor in the Brunswick pinsetter which comprises the source of power for operating the pin retrieval functions of the latter. Separate belt and pulley drives 12 and 14 are driven by this motor both of which operate continuously in the pinsetter as designed. For purposes of identification, drive 12 is the power transfer mechanism that drives a gear box which has been indicated by numeral 16 while drive 14 is operatively connected to the so-called "elevator idler arm" (not shown). A normally disengaged magnetic clutch 18 is interposed between motor 10 and drives 12 and 14, operative upon energization in the well-known manner to produce an operative connection therebetween. More important, however, is the alternative function, namely, that of temporarily and intermittently disengaging these drives from the motor so as to reduce the wear thereon when the pin retrieval functions of the pinsetter driven by this motor are not needed. Tests have shown that the normal life expectancy of the pinsetter can be increased 45% and more by thus deactivating these key portions of the unit after they have performed their respective pin retrieval functions.

Next, by way of background information, certain of the functions of the Brunswick pinsetter need to be set forth for a proper understanding of the control circuit of FIG. 5 which deactivates them in accordance with the teaching found herein. As fully explained in the Brunswick patent previously referred to, the system is supplied with a minimum of two full sets of pins, i.e. at least 20. One set is standing in the alley in position for the bowler to try and knock them down while the second set is stored overhead ready to be placed on the alley once the first set has been removed either by the ball or the alley raking mechanism. The latter mechanism first sweeps the downed pins into a pit at the rear end of the alley after the first of the two balls in each frame has been rolled. Next, it sweeps all the remaining pins into the pit, both downed and those left standing after the second ball has been thrown. After the first ball has been rolled, the pins left standing are picked up and elevated out of the way while the rake moves therebeneath.

From the standpoint of the instant invention, some of the significant operations in the pinsetting sequence will now be set forth. As the first ball is thrown, it or the pins it knocks down, strikes a cushion suspended behind the pins. Striking this cushion initiates movement of a shaker table comprising part of what has been referred to here as the "pin retrieval subassembly." This shaker table receives the pins that have been knocked down and, presumably, thrown to the rear of the alley into a pit in which it is located. As it shakes, the table moves the downed pins one at a time into a hoop-shaped elevator that carries them up and overhead. As the pins leave the elevator they are oriented large-end first and deposited upon a conveyor that moves them forward to a ring of pin-receiving pockets positioned to accept the pins as they leave the conveyor one at a time. Both the pin-elevator and the conveyor also comprise parts of the conventional Brunswick pinsetter and, for present purposes they also comprise parts of the pin retrieval subassembly driven by motor 10. As each pin is deposited in the waiting pocket, the ring indexes one-tenth of a revolution until all ten pockets are filled.

Except as will be pointed out hereinafter, once the alley has been raked clean of pins and the pin-storage subassembly includes a full complement of ten pins, all the functions performed by the pin retrieval apparatus become unnecessary, i.e. the shaker deck is not needed to move any more pins from the pit into the elevator, the elevator need not raise any more pins up to the overhead conveyor and the conveyor need not supply any more pins to the storage deck. Therefore, it is at this stage that the pin retrieval function can be shut down to save wear and tear thereon while awaiting the delivery of another ball that normally signals the need for additional pin retrieval.

While the foregoing expresses the basic approach to the shut down of the pin retrieval function, it does not tell the whole story. If, after the first ball in a given frame is thrown, there are still some pins left standing, the pinsetter functions to lower the pin-storage deck part way down. During this operation the standing pins are picked up leaving the downed pins to be swept into the pit at the rear of the alley by the rake before the standing pins are placed back where they were before. All during this sequence, the pin-storage desk contains its full complement of ten pins and, as a result, the pin retrieval subassembly is not needed to supply additional pins thereto. Nevertheless, the pin retrieval function performed by the shaker table is, in fact, still necessary, namely, that of clearing the pit of downed pins swept therein by the rake. Accordingly, the pin retrieval function must be performed even though the pin-storage deck is full and, for this reason, a portion of the clutch control circuit soon to be described is keyed to this rake cycle while another portion responsive to emptying of the pin-storage deck remains inoperative. Looking at it another way, the rake cycle controls reestablishment of the pin retrieval function when none or at least less than all the pins is knocked down by the first ball.

The second possibility is, of course, the one in which the bowler gets a strike. In this situation, the striking of the pit cushion by the ball or pins initiates the rake function as before; however, when the pin storage deck comes down to lift the pins left standing up out of the way, it senses that all of them are down at which point it functions to deposit the set of ten pins stored therein onto the alley. This additional movement of the pin deck down to deposit the pins stored therein is used to energize the clutch in a manner soon to be explained and reestablish the pin retrieval cycle. For the present, the thing to remember is that the rake cycle will almost surely be completed before the pin retrieval subassembly can refill the pin storage deck with ten more pins, therefore, the pin retrieval function must continue well after the rake cycle has been completed.

The last situation is that in which not all the pins are knocked down by the first ball and a second ball is thrown. Here, regardless of what happens with the second ball, the pinsetter functions to sweep all the remaining pins into the pit, whether knocked down or left standing. Following this the pin-storage deck lowers all the way down and discharges its complement of ten pins. At this point, conditions are the same as if the bowler made a strike, i.e. the pin retrieval function must continue until the pin-storage deck is full even though the pin-raking cycle has already been completed.

Referring next to FIGS. 2 and 3, FIG. 2 shows the position of the deck-lowering linkage that has been indicated in a general way by DL when the pin-storage pockets associated with the overhead pin-placement mechanism are full, i.e. they contain their complement of ten pins. FIG. 3, by way of contrast, shows the same deck-lowering linkage when the pin-storage pockets are empty or contain fewer than ten pins.

Now, everything in FIGS. 2 and 3 is found on the prior art Brunswick automatic pinsetter of the type previously alluded to except for mercury switch 20. This switch tilts upon rotation of shaft 22 between the open position of FIG. 2 and the closed position of FIG. 3. It is open, therefore, anytime the pin-storage mechanism contains a full set of ten pins.

With the deck-lowering linkage DL in the position of FIG. 2 signifying a full deck, the first ball is rolled and strikes the cushion hanging down over the pit behind the pins. As it does so, the pin-placement and pin-sweeping mechanisms are both activated, the former to lift up the pins left standing while the latter sweeps the downed pins into the pit. As the pin-placement mechanism lowers to engage and lift the pins left standing, the linkage shown in FIGS. 2 and 3 operates; however, shaft 22 does not turn all the way from the FIG. 2 to the FIG. 3 position. Instead, it turns only part way and mercury switch 20 is mounted such that it remains open during this partial rotation for the reason that has already been explained.

The pinsetter functions upon the second ball in each frame striking the curtain or ball cushion to actuate the rake to sweep all the remaining pins into the pit regardless of whether they were knocked down or not. The pin-placement mechanism functions to place a full set of ten pins back down on the alley following each strike or completion of a frame. It is this operation that rotates shaft 22 all the way from its FIG. 2 position into that shown in FIG. 3. As previously noted, this closes mercury switch 20. The pin-receiving pockets are now empty of pins and it again becomes necessary to refill the pockets with another set of ten pins. As previously explained, the rake cycle will ordinarily be complete at this point, yet, the pin retrieval function must go on until the pin-storage deck is full. Once it is full, the deck-lowering linkage DL will return to the position shown in FIG. 2 opening mercury switch 20 and deactivating the clutch in a manner to be set forth presently in connection with FIG. 5.

The other key subassembly of the pinsetter insofar as the instant control system is concerned is that of the rake mechanism, the key elements of the actuating linkage therefor having been indicated in a general way by RL and shown in FIG. 4 to which reference will next be made. Once again, the entire linkage illustrated forms part of the prior art Brunswick pinsetter, the only addition thereto being switch 24 mounted in the path of rocker arm 26. The sweeping cycle of the rake is initiated as before by the ball striking the cushion overhanging the pit at the rear of the alley. The rake is cyclic in its operation moving forward over the downed pins and underneath the standing pins that have been elevated out of the way by the pin-placement subassembly to an extended position ahead thereof before being lowered and retracted along the alley to sweep the pins into the pit. The pulley 28 is part of the gear box 16 shown in FIG. 1.

Rocker arm 26 is normally biased by tension spring 30 into the phantom line position where it releases normally closed microswitch 24 into closed position. Cam 32 operates upon cam follower 34 on the end of rocker arm 36 and pushrod assembly 38 to place rocker arm 26 in its full line position overcoming the bias of spring 30 upon completion of the sweep cycle of the rake. As the rocker arm returns to the full line position shown, it engages and reopens the normally closed microswitch.

With the foregoing background, reference will next be made to the circuit diagram of FIG. 5 which is the disabling circuit that acts upon conventional magnetic clutch 18 and shuts down pin retrieval functions controlled by the apparatus of FIGS. 2, 3, and 4 when it is not needed. Line voltage between $L_1$ and $L_2$ is fed through a standard circuit breaker 40 and safety switch 42 to the control circuit of the instant invention which has been designated broadly by reference characters CC. Mercury switch 20 and microswitch 24 are wired in parallel with one another and in series with the first of two bridges $B_1$ which is of conventional design and fective to change alternating to direct current. The C output of first bridge $B_1$ is fed directly to the coil of agnetic clutch 18 thus defining the main current path perative to energize and engage clutch 18 which, in rn operates the pin retrieval mechanism 12, 14 of the runswick pinsetter. On the other hand, with switches 0 and 24 actuated into open position (FIG. 2 and the ll line position of FIG. 4) the main current path rough $B_1$ will be open.

With the main current path through one of the paral- l switches 20 or 24 open, the clutch would ordinarily isengage; however, it has been found that not all of the in retrieval functions driven by drives 12 and 14 are ecessarily completed at this point. For instance, it has lready been noted that the mercury switch 20 is only eleased to closed position when a strike is rolled or the econd ball is thrown, otherwise, the pin-placement ubassembly only lowers halfway to pick up the pins eft standing and this is insufficient movement to close witch 20. Thus, only the rake cycle is operative rough switch 24 to energize clutch 18 and initiate the in retrieval functions. Unfortunately, this rake cycle ay be, and often is, complete before the pin retrieval nction has progressed as far as it should. Specifically, e shaker deck may not have had time to clear all the owned pins from the pit. This and other circumstances ot necessarily keyed to completion of the rake cycle or e pin-placement cycle of the pinsetter have been reponsible for one of the main innovations in the imroved control circuit of the instant invention, namely, n alternate current path to clutch 18 operative to mainin the latter engaged for a brief time interval after the ain current path thereto has opened.

As shown in FIG. 5, this alternate current path parals the main current path through bridge $B_1$ and inludes a second bridge $B_2$ wired in series with the norally open contacts 44 of a thermal tube TT that also cludes a thermal element 46. This thermal tube is of onventional design and its element 46 is a bimetallic ne operative when energized to actuate contacts 44 to closed position. Alternatively, when the current is ut off from the thermal element 46, it slowly cools off ver a period of several seconds and eventually reopens ontacts 44. During this interval after the main current ath has opened, of course, the alternate current path to he clutch 18 exists and the latter keeps the pin retrieval nctions driven by drives 12 and 14 going. After a lapse f the "holding" period during which the thermal elenent cools off enough to reopen contacts 44, the pin etrieval functions have continued to operate long nough to insure that they are essentially complete.

The alternate current path through contacts 44 and ridge $B_2$ should not be relied upon as the primary eans for energizing clutch 18 because of the time elay factor involved. In other words, it takes essenially the same length of time for thermal element 46 to eat up and close contacts 44 as it does to cool and eopen them. During this so-called "warm-up" period, o pin retrieval functions would be going on at all thus ignificantly delaying a critical operation of the pinseter. The main current path through $B_1$, of course, anwers this need by instantaneously energizing clutch 18 nto engage position as soon as either switch 20 or witch 24 is released to their normally closed positions. Note also in this same connection that if for some reason hermal tube TT fails or otherwise malfunctions, the nain current path through $B_1$ remains effective to conrol the pin retrieval function with the only loss being the holding function brought to the system by the alternate current path through $B_2$.

Now, since the main current path through $B_1$ is completed through switch 24 just as soon as a ball hits the pit cushion, this main current path is tapped into between switches 20 and 24 and bridge $B_1$ to supply A.C. power to the bimetallic element 46 of the thermal tube. This branch A.C. current path through parallel switches 20 and 24 connected in series with thermal element 46 becomes instantly operative to start the latter heating up and it will have functioned to close contacts 44 well in advance of the time switches 20 or 24 or both are actuated into open position assuming the latter switch closed at all.

Finally, it will be seen from the foregoing that not only has applicant developed a novel control circuit for deactivating the pin retrieval functions of a Brunswick pinsetter during those intervals when it is not needed but, a unique method as well. In essence, this method comprises using the initiation of the pinsetter's normal pin-raking cycle to both initiate its pin retrieval function and ready a holding circuit operative to maintain the latter after the pin-raking cycle is complete, sustaining the pin retrieval function after the pin-raking cycle is complete for the time interval required to complete the pinsetter's pin-placement function upon actuation of the latter in a manner to place a new set of pins in play, and continuing the pin retrieval function through the holding circuit for a time interval following completion of either the pin-raking cycle or both it and the complete pin-placement cycle when the latter is actuated to completion.

What is claimed is:

1. For use in combination with an automatic pinsetter device having: a cyclically operable pin-raking subassembly responsive to the pressure of each bowled ball in a given frame to sweep that portion of the alley whereat the pins are stood, a cyclically operable pin-placement subassembly for lifting the pins left standing after the first ball is thrown in a given frame while the pin-raking subassembly sweeps the downed pins from therebeneath and for loading and replacing the set of pins following either a strike or completion of a frame, a pin retrieval subassembly operative upon actuation to receive the pins swept from the alley by the pin-raking subassembly and deliver said pins to the pin-placement subassembly, drive means, and a normally disengaged magnetic clutch engageable to form an operative drive connection between said drive means and said pin retrieval subassembly; an improved control circuit for periodically activating and selectively or temporarily deactivating said pin retrieval subassembly, which comprises:

(1) a main current path and an alternate current path connected in parallel therewith, each connected to a source of electrical energy and each operatively connected in series with said magnetic clutch for actuating said magnetic clutch into an energized and engaged position;

(2) first switch means connected in series in said main current path and operable to effect the instantaneous activation of the pin retrieval operation of said pin retrieval subassembly, said first switch means being operatively associated with said pin-raking subassembly of the automatic pinsetter device, said pin-raking subassembly operable to release said first switch means into its normally closed position during the pin-raking cycle of operation and, upon completion thereof, actuating said first switch means into an open position;

(3) second switch means connected in circuit both in parallel with said first switch means and in series in said main current path and operable to effect the instantaneous activation of the pin retrieval operation of said pin retrieval subassembly, said second switch means being operatively associated with said pin-placement assembly so as to be actuated thereby to its normally closed position during the cyclic operation of said pin-placement subassembly and, upon completion thereof, actuated into an open position, said second switch means cooperating with said first switch means to instantaneously initiate and maintain operative the pin retrieval function of said automatic pin-setter device following the completion of its pin-raking function and while that portion of its pin-placement function, which results in said pin-placement subassembly being loaded with a second full set of pins, continues;

(4) a branch circuit path connected between said main and said alternate current paths and containing a current responsive thermal element connected in series with said first and said second switch means, said thermal element being energized upon the completion and activation of said main current path via the actuation of said first switch means or said second switch means to a closed position;

(5) said alternate current path constituting a holding circuit and including a third switch means responsive to the energization and operation of said thermal element for completing and activating the said alternate current path to thereby maintain the actuation of said magnetic clutch into its said energized and engaged position, and thereby maintain the pin retrieval operation of said pin retrieval subassembly;

(6) said thermal element and said third switch means cooperating with one another to establish the operation of said alternate current path when said third switch means is actuated to its closed position to thereby maintain operative the said pin retrieval function of said automatic pinsetter device for a time interval following the opening of said main current path and the completion of both the said raking cycle of operation and the pin-storage cycle of operation of said automatic pinsetter device, said time period commencing at a time at which both of said first and said second switch means are actuated to an open position, thereby opening said main current path and removing the supply of current from said thermal element, and continuing until the time at which said thermal element operates to actuate the said third switch means to its open position, whereupon the said alternate current path constituting a holding circuit opens, becomes inoperative, and ceases to maintain operative said pin retrieval function; and, (7) said first and said second switch means operatively cooperating with each other, upon the actuation of either thereof into a closed position, to effect the instantaneous activation of the said main current path and the said pin retrieval function in advance of and preparatory to the activation and operation of the said holding circuit.

2. The improved control circuit as set forth in claim 1 wherein the thermal element comprises a bimetallic member.

3. The improved control circuit as set forth in claim 1 wherein both the thermal element and the third switch means controlled thereby comprise elements of a thermal tube.

4. The improved control circuit as set forth in claim 1 wherein: said improved control circuit is connectable to a source of alternating current; and, said main current path and said alternate current path each include a bridge means operative to change alternating to direct current.

5. The improved control circuit as set forth in claim 4 wherein said thermal element is responsive to alternating current and is connected in said branch circuit path to bypass the bridge means contained in said main current path.

6. The improved control circuit as set forth in claim 4 wherein the said third switch means is connectable, upon actuation to its closed position, in series with the bridge means included in the said alternate current path to control the energization thereof.

7. The improved control circuit as set forth in claim 1 wherein said second switch means comprises a mercury switch device.

8. The improved control circuit as set forth in claim 7 wherein said second switch means is actuated to an open position whenever the pin-storage mechanism associated with the said pin-placement subassembly contains a full set of pins.

9. The improved control circuit as set forth in claim 1 wherein said first switch means comprises a microswitch device.

10. An improved method for use in periodically activating and selectively or temporarily deactivating the pin retrieval function of an automatic pinsetter device of the type having: a pin-raking function cyclically responsive to each ball thrown, a pin-storage function cyclically operable to load and place a full set of pins on the alley after each occurrence of a strike or completion of a bowled frame, drive means, and a normally disengaged magnetic clutch engageable to form an operative drive connection between said drive means and a pin retrieval subassembly which operates to accomplish the pin retrieval function; said improved method comprising:

(1) providing a main current path and an alternate current path connected in parallel therewith, each connected to a source of electrical energy and each operatively connected in series with said magnetic clutch;

(2) providing a branch circuit path connected in series with said main current path and further connected between said main current path and said alternate current path;

(3) actuating said magnetic clutch into an energized and engaged position via the application of current through either of said main and said alternate current paths to thereby effect the instantaneous activation of the pin retrieval function;

(4) utilizing the pin-raking cycle and the pin-storage cycle operations to control the operation of said main current path;

(5) initiating the operation of the pin retrieval function simultaneously with the commencement of the pin-raking cycle by actuating said magnetic clutch into an energized and engaged position via said main current path;

(6) simultaneously energizing said branch circuit path and thereafter utilizing the said branch circuit path to establish and control the operation of said alternate current path;

(7) utilizing said alternate current path as a holding circuit for maintaining operative said pin retrieval function for a time interval following the opening of said main current path and the completion of both the pin-raking and pin-storage cycles of operation of said automatic pinsetter device; and, (8) commencing said time interval at a time at which said main current path opens and continuing said time interval until the time at which said alternate current path opens whereupon the said alternate current path constituting said holding circuit becomes inoperative, to cease actuating said magnetic clutch to said energized and engaged position, and ceases to maintain operative said pin retrieval function.

* * * * *